US007032656B2

(12) United States Patent
Lamich

(10) Patent No.: US 7,032,656 B2
(45) Date of Patent: Apr. 25, 2006

(54) HEAT EXCHANGER, ESPECIALLY FOR MOTOR VEHICLES

(75) Inventor: Bernhard Lamich, Esslingen (DE)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 10/960,376

(22) Filed: Oct. 7, 2004

(65) Prior Publication Data

US 2005/0077035 A1 Apr. 14, 2005

(30) Foreign Application Priority Data

Oct. 10, 2003 (DE) ..... 103 47 180

(51) Int. Cl.
*F28F 9/16* (2006.01)

(52) U.S. Cl. ..... 165/173; 165/149; 165/175

(58) Field of Classification Search ..... 165/149, 165/153, 173, 175

See application file for complete search history.

(56) References Cited

U.S. PATENT DOCUMENTS 2,073,778 A * 3/1937 Boerger ..... 165/151
2,899,177 A * 8/1959 Harris et al. ..... 165/153
3,275,070 A * 9/1966 Beatenbough et al. ..... 165/175
5,355,941 A * 10/1994 Blankenberger et al. .... 165/153
5,607,012 A * 3/1997 Buchanan et al. ..... 165/173
5,836,384 A * 11/1998 Wijkstrom et al. ..... 165/173
6,012,512 A * 1/2000 Ghiani ..... 165/153
6,035,931 A * 3/2000 Kado et al. ..... 165/153
6,250,381 B1 * 6/2001 Nishishita ..... 165/175
6,293,334 B1 * 9/2001 Ghiani ..... 165/149
6,302,196 B1 * 10/2001 Haussmann ..... 165/153
2004/0069468 A1 4/2004 Lamich et al.
2005/0016717 A1 1/2005 Lamich et al.

FOREIGN PATENT DOCUMENTS

DE 102 37 769 A1 2/2004
DE 103 33 150 A1 2/2005
GB 2098313 A * 11/1982 ..... 165/149

* cited by examiner

*Primary Examiner*—Leonard R. Leo
(74) *Attorney, Agent, or Firm*—Wood, Phillips, Katz, Clark & Mortimer

(57) ABSTRACT

A heat exchanger including a core with tubes and ribs between tube plates, two collecting tanks on the tube plates, and closure caps, all produced from solder-coated aluminum. The core includes a plurality of alternating flat tubes and ribs between spaced tube plates. Each collecting tank has two longitudinal walls joined to the longitudinal connection edges of one of the tube plates. The closure caps close ends of the collecting tanks, and have an edge aligned substantially parallel to the collecting tank walls. The edges of the longitudinal walls of the collecting tanks are arranged between the longitudinal connection edges of the tube plates, with protrusions on the edges of the longitudinal walls inserted in openings in the tube plates. The transverse connection edges of the tube plates have a contour cut-out matching the closure cap profile to form a tight and strong solder bond with the closure caps.

9 Claims, 5 Drawing Sheets

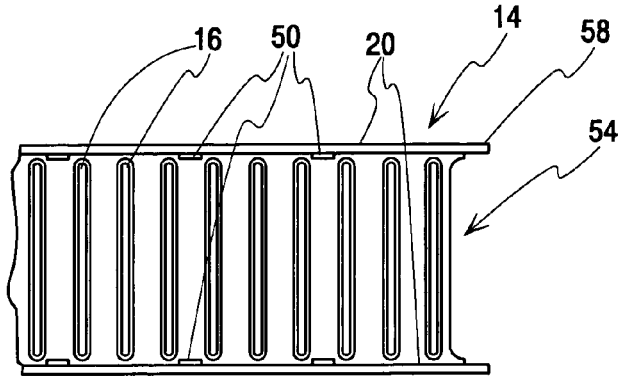
Fig. 9
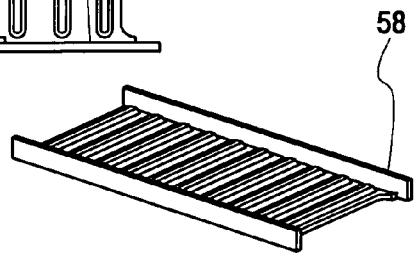
Fig. 10
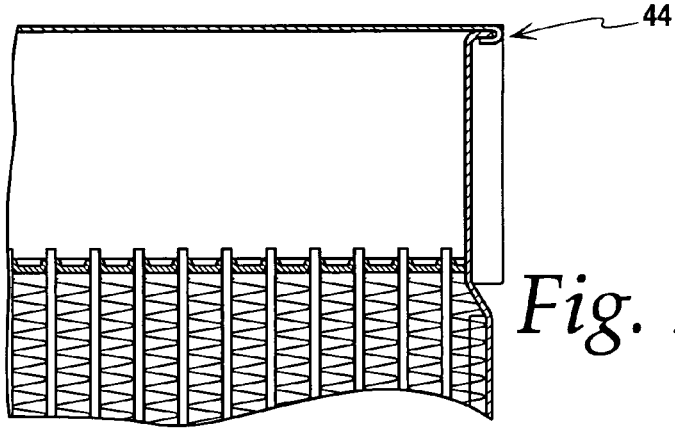
Fig. 11
Fig. 12
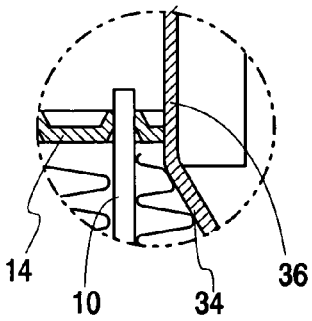
Fig. 13
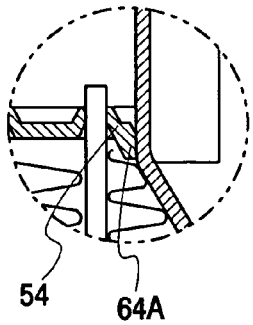
Fig. 14
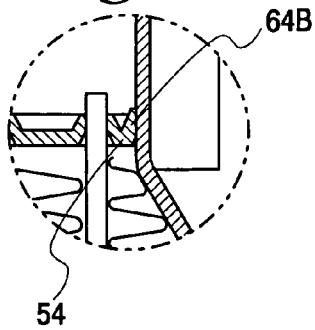

HEAT EXCHANGER, ESPECIALLY FOR MOTOR VEHICLES

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

1. Technical Field

The present invention relates to heat exchangers, and more particularly to aluminum motor vehicle heat exchangers having collecting tanks with side openings closed by closure caps.

2.Background of the Invention and Technical Problems Posed By the Prior Art

Heat exchangers of interest to the present invention are disclosed in file number DE 103 33 150.6 (filed Jul. 22, 2003 at the DPMA) and DE 102 37 769.3 (filed on Aug. 17, 2002 at the DPMA).

The present invention provides a still further development of this state of the art.

SUMMARY OF THE INVENTION

In one aspect of the present invention, a heat exchanger is provided, including a core, two collecting tanks, and closure caps, all produced from solder-coated aluminum facilitating formation of a metallic bond therebetween via a soldering process. The core includes a plurality of alternating flat tubes and ribs, with the flat tubes on opposite ends extending through openings in spaced tube plates, where each of the tube plates have longitudinal and transverse connection edges forming four corner regions. Each collecting tank has two longitudinal walls joined to the longitudinal connection edges of one of the tube plates. The closure caps close ends of the collecting tanks, and have an edge aligned substantially parallel to the collecting tank walls. The edges of the longitudinal walls of the collecting tanks are arranged between the longitudinal connection edges of the tube plates, with protrusions on the edges of the longitudinal walls inserted in openings in the tube plates. The transverse connection edges of the tube plates have a contour cut-out matching the closure cap profile to form a tight and strong solder bond with the closure caps.

In one form of this aspect of the present invention, at least one fixing member is adapted to secure the closure cap to the collecting tank. In one further form, the fixing member is a bendable bracket on the collecting tank and bendable into a notch cut-out in an edge of the closure cap. In another further form, the fixing member comprises at least one clamp on an edge of the closure cap and adapted to grip over an edge of the collecting tank.

In another form of this aspect of the present invention, the contour cut-outs of the transverse connection edges are provided between the longitudinal connection edges of the tube plates.

In still another form of this aspect of the present invention, the contour cut-outs are formed between two protruding longitudinal connection edges and have a gradation on each side, wherein the gradation size corresponds to the wall thickness of the corresponding collecting tank. In a still further form, the solder bond is formed in each corner region between the protruding longitudinal connection edge, the edge of the closure cap, and one of the longitudinal wall protrusions, wherein the one protrusion is between the edge and the longitudinal connection edge.

In yet another form of this aspect of the present invention, at least one region of the contour cut-out is adapted to be selectively formed like a flange, where the flange provides a surface area for the soldering bond of the tube plate to the closure cap.

BRIEF DESCRIPTION OF THE DRAWINGS

FIGS. 4 through 8 are section views taken along lines 4—4, 5—5, 6—6, 7—7 and 8—8, respectively, in FIG. 3 (FIG. 7 differs from FIG. 8 in showing a section in the region of a flat tube 1 whereas FIG. 8 shows a section in the region of a protrusion);

FIG. 9 is a top view of part of a tube plate according to the invention;

FIG. 10 is a perspective view of the tube plate part of FIG. 9;

FIG. 11 is a section view taken along line 11—11 in FIG. 6;

FIGS. 12—14 are detailed views from FIG. 11 showing different variations of the tube plate flange according to the present invention.

DETAILED DESCRIPTION OF THE INVENTION

Figure 1:
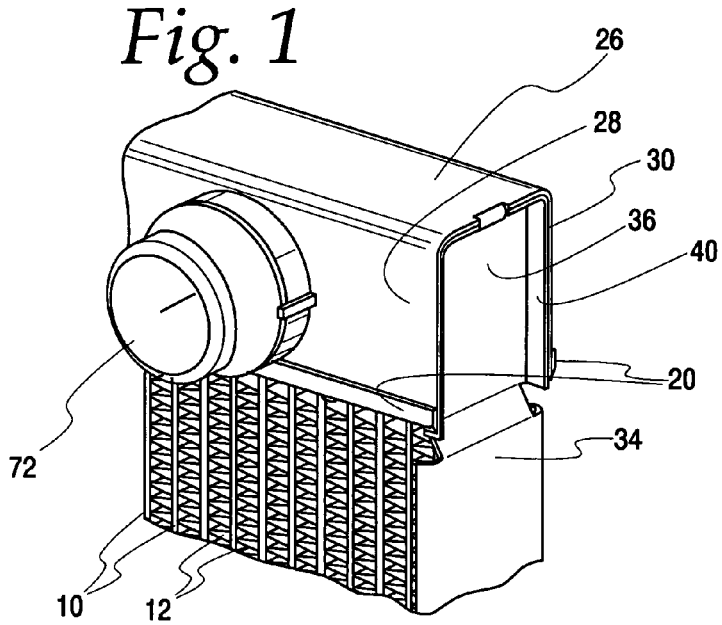
FIG. 1 is a perspective partial view of a heat exchanger according to the invention.

The figures show a heat exchanger particularly adapted for use in motor vehicles. The heat exchanger includes flat tubes 10, corrugated ribs 12, and tube plates 14. Openings 16 in the tube plates 14 hold the ends of flat tubes 10, and longitudinal and transverse connection edges 20, 22 form four corner regions.

The heat exchanger also includes collecting tanks 26 with two longitudinal walls 28, 30 for connection with the longitudinal connection edges 20 and with side parts or plates 34 having closure caps 36, for closing the side openings of the collecting tanks 26, where the closure caps 36 have a beveled edge 40.

Moreover, in the practical example shown, members 44 are provided to fix the heat exchanger at the edge of the collecting tank 26 and to the edge 40 of cooperating closure cap 36.

All the parts of the heat exchanger mentioned above may advantageously be made from aluminum sheet which is expediently coated with solder in order to produce a metallic bond using a soldering process. (As used herein, the terms solder and soldering include braze alloy and brazing.)

The longitudinal walls 28, 30 of the collecting tanks 26 are arranged between the longitudinal connection edges 20 of the tube plates 14. Further, protrusions 48 are provided on the longitudinal walls 28, 30 and are inserted into the corresponding openings 50 in the tube plates 14.

The longitudinal connection edges 22 of the tube plates 14 have a contour cut-out 54 which forms a tight and strong soldering bond with the closure caps 36. The protrusions 48 may advantageously have a slightly conical form so that a certain guidance is provided into openings 50 and while at the same time ensuring that the protrusions 48 lie tightly at the edge of openings 50. The protrusions 48 and the openings 50 are arranged at appropriate distances so that they can fulfill their function. Since, in the regions around openings 50, sufficient soldering material is available, a tight soldered bond of protrusions 48 in openings 50 is expected and at the same time a high process safety is provided. The openings 50 in the tube plate 14 are preferably arranged between the openings 16 for the flat tube ends, so that a maximum depth of the tube-rib-block is provided. Furthermore, they are preferably located directly at the longitudinal connection edge 20.

Figure 2:
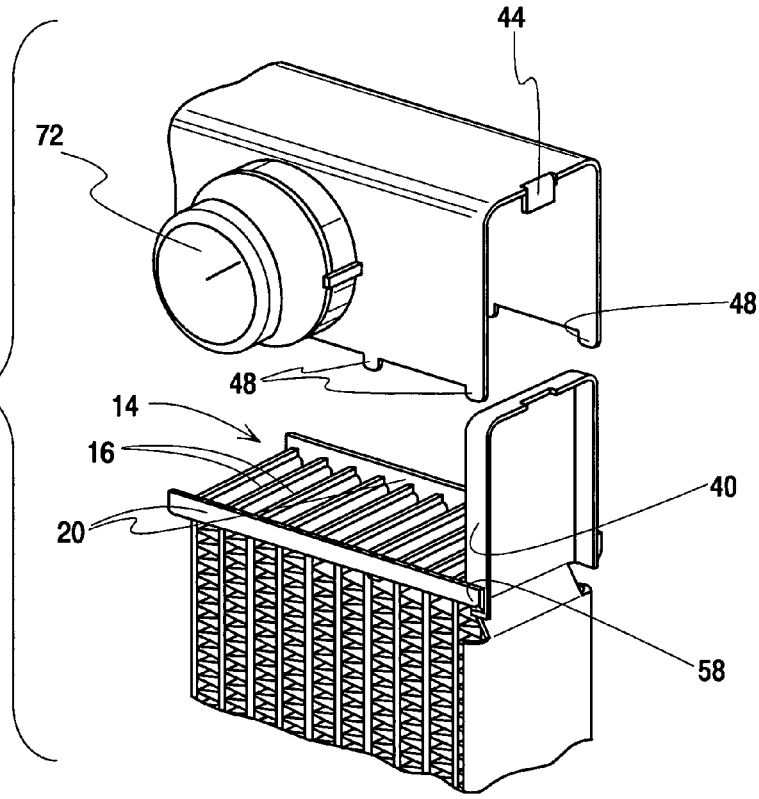
FIG. 2 is a partially exploded view of the heat exchanger of FIG. 1, showing assembly prior to the attachment of the collecting tank.
Figure 3:
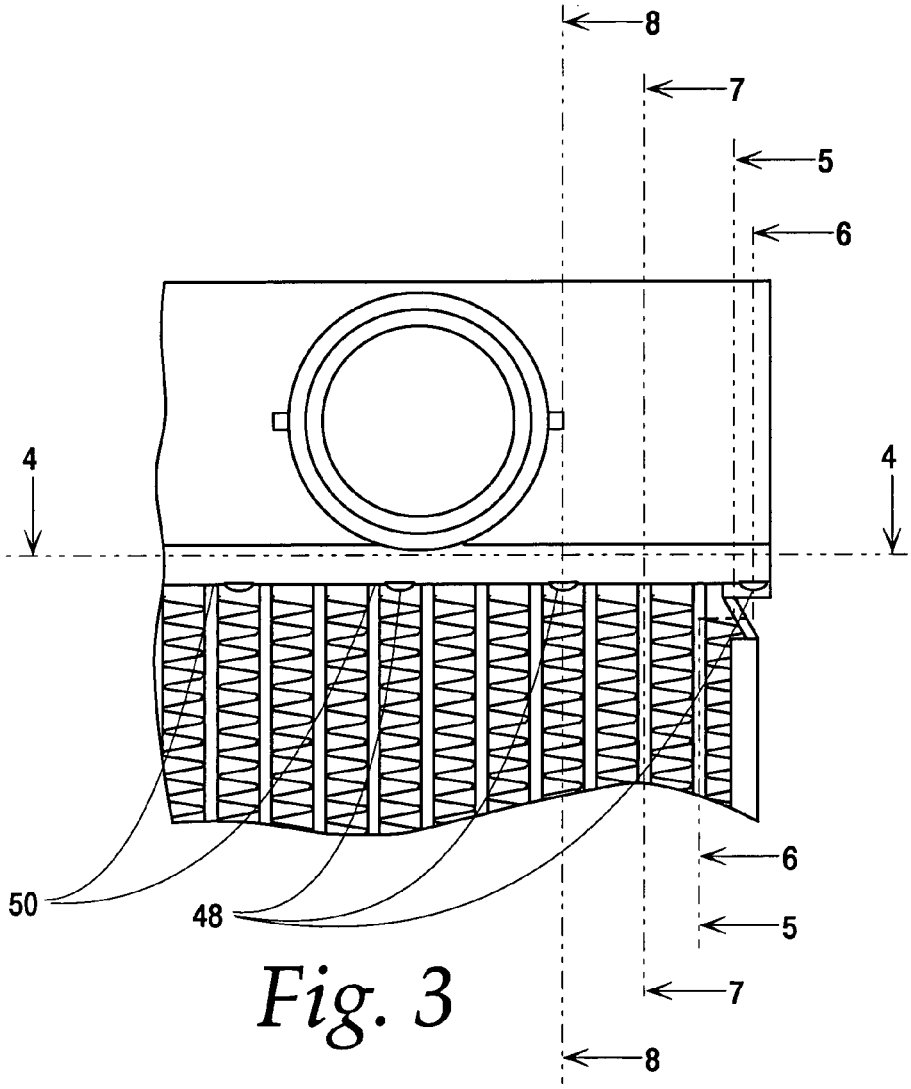
FIG. 3 is a partial front view of the heat exchanger of FIG. 1.
Figure 4:
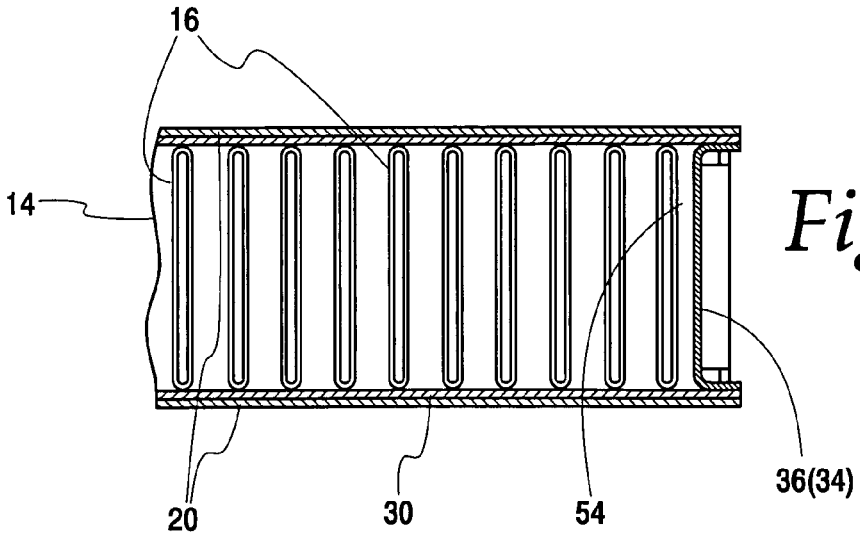
Figure 5:
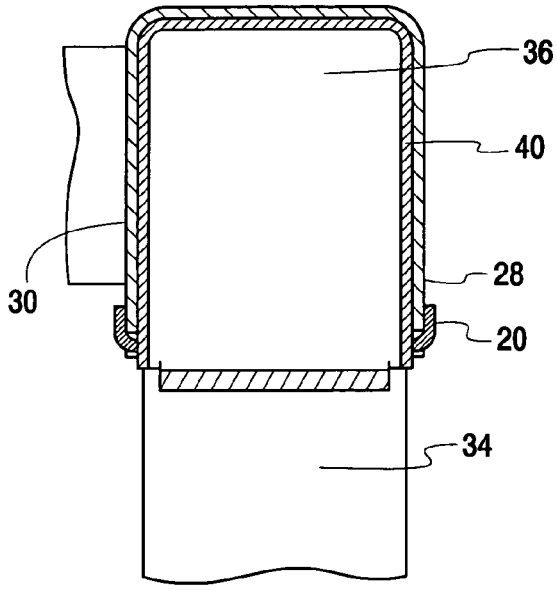
Figure 6:
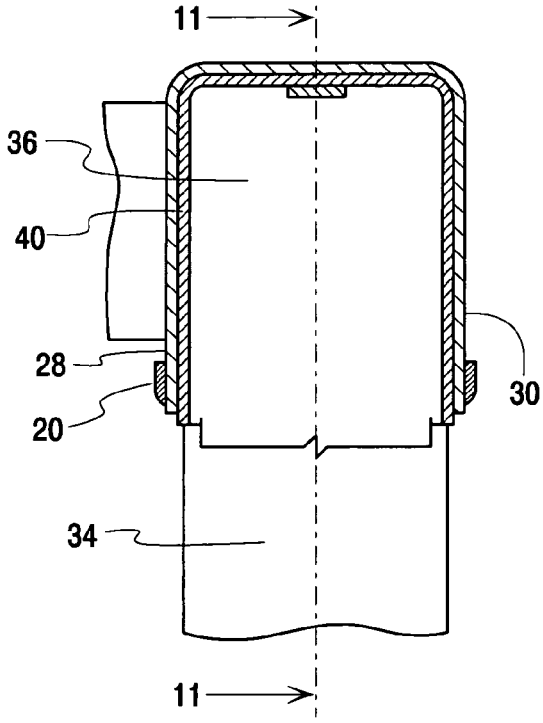
Figure 7:
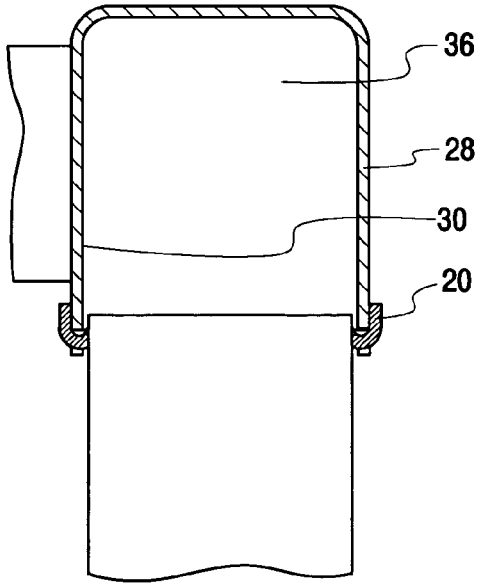
Figure 8:
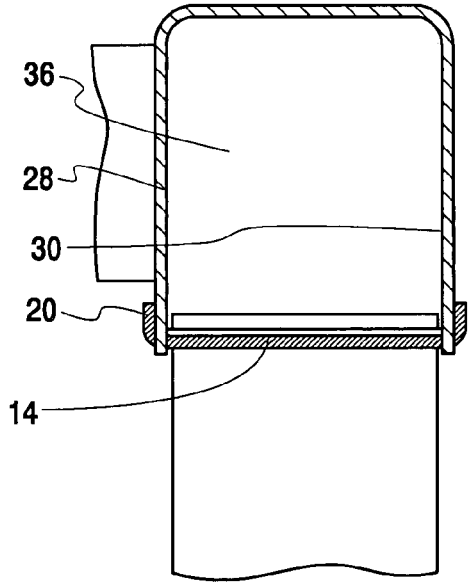

The contour cut-out 54 of the transverse connection edges 22 is provided between the longitudinal connection edges 20. The contour cut-out 54 corresponds approximately to the contour of closure cap 36, so that a strong and tight soldered bond is also achieved therebetween. Thus, the contour of the cut-out depends on the selected contour of closure cap 36. As shown especially in FIG. 2, in combinations with FIGS. 9 and 10, the contour cut-out 54 in the practical example is designed so that the two longitudinal connection edges 20 protrude somewhat beyond the remaining transverse connection edge 22 of the tube plate 14 (the protruding longitudinal connection edges are indicated by reference number 58 in FIGS. 2, 9 and 10).

Furthermore, the contour cut-out 54 in the practical example may advantageously include a gradation 60 on both sides, the size of which corresponds approximately to the plate thickness of the collecting tanks 26 and to the plate thickness of the longitudinal walls 28, 30, respectively. The protruding longitudinal connection edges 58 thus each take up a protrusion 48 between them and the edge 40 of closure cap 36. In the case of tube plates 14 which have a somewhat larger plate thickness, the connection between their transverse connection edge 20 and the closure cap 36 can be formed without a flange, as shown in FIG. 12. On the other hand, FIGS. 13 and 14 show a flange 64*a, b*, where in FIG. 13 the flange 64*a* is directed downward and in FIG. 14 the flange 64*b* is directed upward in order to create a strong and tight soldered bond even when the tube plates 14 are thinner.

Cut-outs or notches 70 may also be advantageously be provided at the edge 40 of the closure cap 36, into which the fixing members 44 (such as a bracket) on the transverse wall of the collecting tank 26 may be bent. This member provides a temporary holding of the heat exchanger during the manufacturing phase. The partial longitudinal section shown in FIG. 11 goes exactly through the fixing member 44 and shows the members 44 (bracket) in the already bent state.

The mounting process of the heat exchanger according to one aspect of the invention is as follows.

The flat tubes 10 are arranged alternatingly with the corrugated ribs 12 to the so-called rib-tube-block. Then the side parts 34 with closure caps 36 are mounted.

Tube plates 14 are then mounted on both ends of the flat tubes 10, after which the ends of flat tubes 10 are inserted into the openings 16 of the tube plates 14 (only one end is shown in the figures, but it should be appreciated that the same structure may be provided on both ends). Finally, the collecting tanks 26 are placed onto the tube plates 14 and the protrusions 48 are pushed into openings 50. Thus, the longitudinal direction of collecting tanks 26 is established.

At the same time, pressing of the longitudinal connection edges 20 of tube plate 3 onto the longitudinal walls 28, 30 of the collecting tanks 26 is achieved. After that, the fixing members 44 are bent into the cut-outs 70 at the edge 40 of the closure caps 36. It should thus be appreciated that at this point the heat exchanger is a self-contained unit, which can be prepared for the soldering process.

It should also be appreciated that a complete heat exchanger is not shown in the figures to avoid unnecessary clutter and to clearly highlight the aspects of the present invention. A person of ordinary skill in the art will readily recognize the suitable additional components and/or features which may be advantageously used with a heat exchanger incorporating one or more aspect of the present invention. For example, a heat exchange medium may enter the collecting tank 26 through an inlet connector 72 (see FIGS. 1 and 2), from which it may be distributed to the flat tubes 10 in order to flow through the tubes 10 to an identical or similar collecting tank (not shown) located on the other end of the heat exchanger (in the longitudinal direction of the flat tubes). An outlet connector (not shown) may be arranged either on the collecting tank 26 shown or on the one not shown, in order to lead the heat exchanger medium away from the heat exchanger.

Cooling air flows through corrugated ribs 12 which advantageously are in heat-exchanging relationship with the medium mentioned. Furthermore, only one side part 34 is shown, but it is understood that a second side part is present on the second side which is not shown (in the transverse direction to the flat tubes), which may be identical at least with regard to the characteristics described here.

Figure 15:
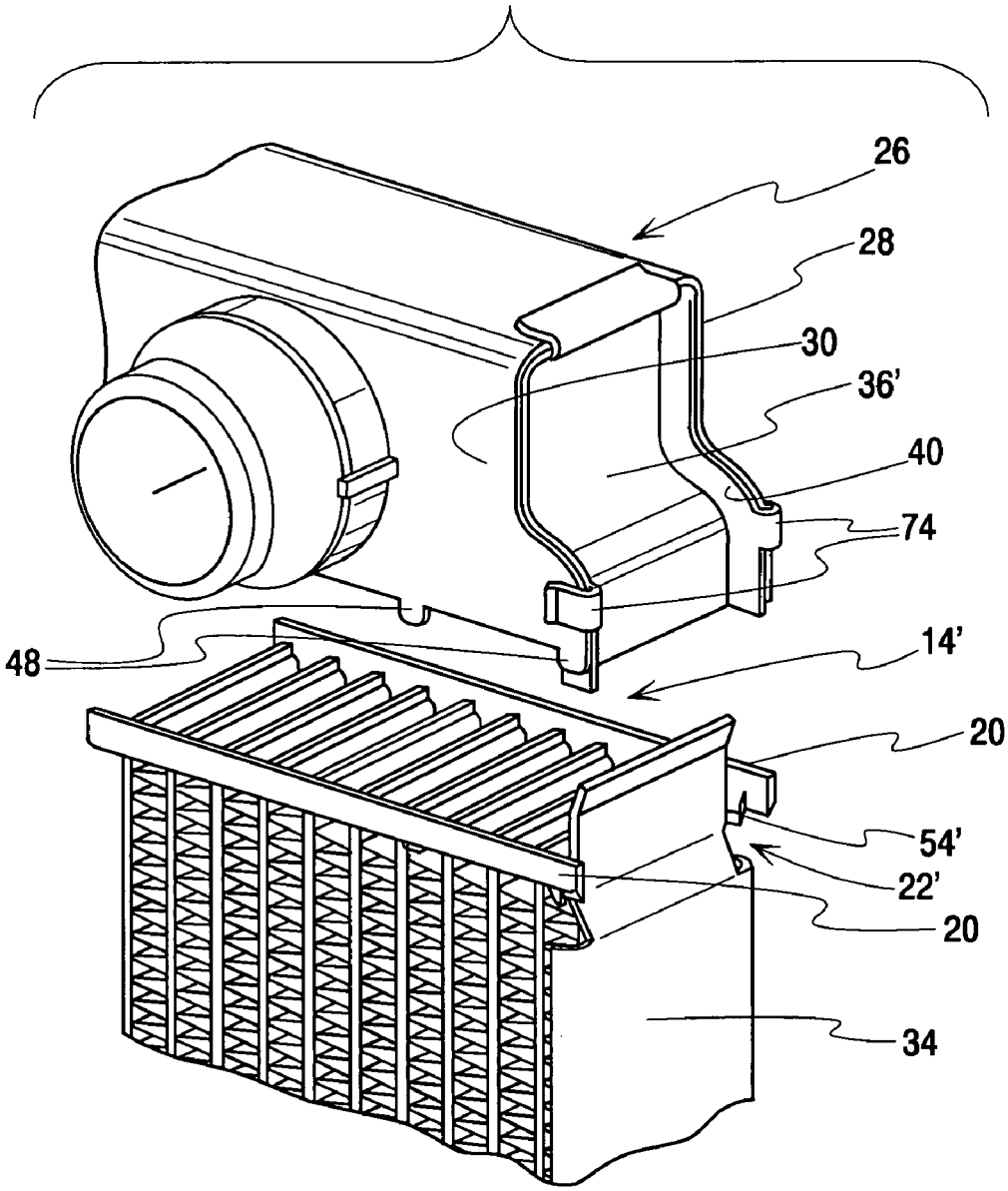
FIG. 15 is a perspective partial view of a second embodiment heat exchanger according to the present invention.

FIG. 15 illustrates an alternative embodiment of the present invention, in which the closure caps 36' are formed as individual parts separate from the core side plates. In this embodiment, contour cut-outs 54' are provided in the transverse connection edges 22' of the tube plates 14'. Furthermore, as described with the previous embodiment, protrusions 48 are present on the edges of the longitudinal walls 28, 30 of collecting tanks 26, which are introduced into the corresponding openings 50 (not seen in FIG. 15) in the tube plates 14'. The fixing members 44 may with this embodiment be particularly advantageously usable, and may consist of clamps 74 formed on the edges 40 of the closure cap 36.

It should be appreciated that good soldered bonds are advantageously provided with the present invention, with the edges of the longitudinal walls 28, 30 of the collecting tanks 26 arranged between the longitudinal connection edges 20 of the tube plates 14, where protrusions 48 are provided on the longitudinal walls 28, 30 which are inserted into the corresponding openings 50 in the tube plates 14, and the transverse connection edges 22 of the tube plates 14 are provided with a contour cut-out 54 so that they form a tight and strong soldering bond with the closure caps 36. The protrusions 48 in the openings 50 cause the longitudinal walls 28, 30 of the collecting tanks 26, when the protrusions 48 are inserted in the openings 50 of the tube plate 14, to be pressed tightly to the longitudinal connection edges 20 of the tube plate 14. The contour cut-out 54 in the transverse connection edges 22 of the tube plates 14 leads to tight soldering bonds in the corner regions of the tube plates 14, and enables the closure caps 36 to be more easily manufactured without requiring sharp edge corners. The flange-like edge also assists in ensuring secure bonding by increasing the bonding surface area to the closure cap. This may be particularly advantageous for use with tube plates which have a reduced thickness.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A heat exchanger comprising:

a core with a plurality of alternating flat tubes and ribs, said flat tubes on opposite ends extending through openings in spaced tube plates, each of said tube plates having longitudinal and transverse connection edges forming four corner regions;

two collecting tanks, each collecting tank having two longitudinal walls joined to the longitudinal connection edges of one of the tube plates;

closure caps closing ends of said collecting tanks, said closure caps having an edge aligned substantially parallel to said collecting tank walls, said core, collecting tanks and closure caps being produced from solder-coated aluminum facilitating formation of a metallic bond therebetween via a soldering process, characterized by the edges of the longitudinal walls of the collecting tanks being arranged between the longitudinal connection edges of the tube plates, with protrusions on the edges of the longitudinal walls inserted in openings in the tube plates, and the transverse connection edges of the tube plates having a contour cut-out matching the closure cap profile to form a solder bond with the closure caps.

2. The heat exchanger of claim 1, further comprising at least one fixing member adapted to secure the closure cap to said collecting tank.

3. The heat exchanger of claim 2, wherein said fixing member comprises a bendable bracket on the collecting tank and bendable into a notch cut-out in an edge of the closure cap.

4. The heat exchanger of claim 2, wherein said fixing member comprises at least one clamp on an edge of the closure cap and adapted to grip over an edge of the collecting tank.

5. The heat exchanger of claim 1, wherein the contour cut-outs of the transverse connection edges are provided between the longitudinal connection edges of the tube plates.

6. The heat exchanger of claim 1, wherein the contour cut-outs are formed between two protruding longitudinal connection edges and have a gradation on each side, wherein the gradation size corresponds to the wall thickness of the corresponding collecting tank.

7. The heat exchanger of claim 6, wherein said solder bond is formed in each corner region between the protruding longitudinal connection edge, the edge of the closure cap, and one of said longitudinal wall protrusions, wherein said one protrusion is between the edge and the longitudinal connection edge.

8. The heat exchanger of claim 1, wherein at least one region of the contour cut-out is adapted to be selectively formed like a flange, said flange providing a surface area for the soldering bond of the tube plate to the closure cap.

9. The heat exchanger of claim 1, further comprising side plates on said core, wherein said closure caps are integrally formed with said side plates.

* * * * *